United States Patent [19]

Leung

[11] Patent Number: 5,056,291

[45] Date of Patent: Oct. 15, 1991

[54] MODULAR SYSTEM FOR SPACE FRAME STRUCTURES

[75] Inventor: Wan-Keung Leung, Kowloon, Hong Kong

[73] Assignee: Skilland Engineering, Ltd., Hong Kong

[21] Appl. No.: 423,390

[22] Filed: Oct. 19, 1989

[51] Int. Cl.[5] ..... E04B 1/32; E04H 12/18

[52] U.S. Cl. ..... 52/637; 52/81; 52/645; 52/646; 52/648; 403/171; 403/176

[58] Field of Search ..... 52/648, DIG. 10, 645, 52/646, 637, 638, 81; 182/178–179; 446/116, 126, 102, 120, 124; 403/171, 176, 172

[56] References Cited

U.S. PATENT DOCUMENTS

| | | | |
|---|---|---|---|
| 2,665,950 | 1/1954 | Johnson | 182/115 |
| 2,760,707 | 8/1956 | Anderson | 182/179 |
| 3,356,394 | 12/1967 | Chamayou | 403/171 |
| 3,407,558 | 10/1968 | Resch | 52/646 X |
| 3,452,989 | 7/1969 | Jernstrom | 446/116 |
| 3,454,131 | 7/1969 | Johnson et al. | 182/115 |
| 3,550,311 | 12/1970 | Fouquart | 52/2 K X |
| 3,565,212 | 2/1971 | Johnson | 182/179 |
| 4,262,461 | 4/1981 | Johnson et al. | 52/81 |
| 4,308,698 | 1/1982 | Fleishman | 52/81 |
| 4,491,437 | 1/1985 | Schwartz | 403/176 |
| 4,548,590 | 10/1985 | Green | 446/125 X |
| 4,922,669 | 5/1990 | De Pas et al. | 403/171 |

FOREIGN PATENT DOCUMENTS

| | | | |
|---|---|---|---|
| 1391973 | 2/1965 | France | 52/648 |
| 2312614 | 1/1977 | France | 403/176 |
| 2331745 | 7/1977 | France | 403/171 |
| 2384074 | 10/1978 | France | 52/648 |
| 2200183 | 7/1988 | United Kingdom | 403/172 |

*Primary Examiner*—David A. Scherbel
*Assistant Examiner*—Deborah McGann Ripley
*Attorney, Agent, or Firm*—Baker & McKenzie

[57] ABSTRACT

The invention is embodied in a modular system for making structural frameworks in which crystal-like hubs are used to connect lightweight struts in a variety of configurations. The hubs are comprised of uniform nodes and cylindrical trunnions, several embodiments of which be used in a structural configuration to create irregular shapes. The struts are equipped with end grips which snap into engagement with the trunnions and nodes of the crystal-like hubs. The end grips have C-shaped gripping sections and stems which fit into a hollow tube which forms the body of the strut. The end grips are free to rotate about the axis of the strut, and the end grips can rotate about the axis of the trunnions to which it is attached. Such freedom of rotation allows complete flexibility of design.

14 Claims, 4 Drawing Sheets

FIG. 1
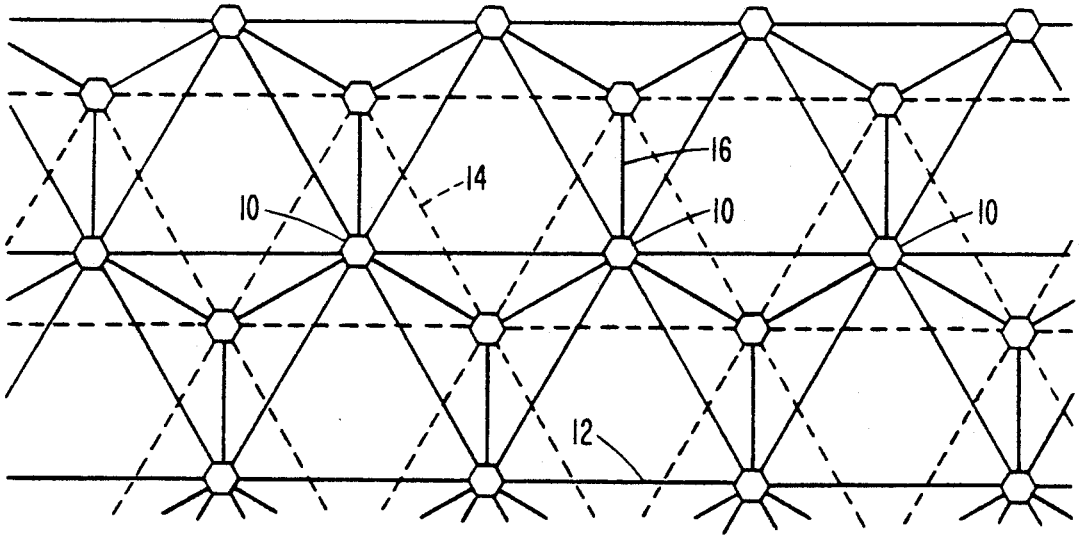
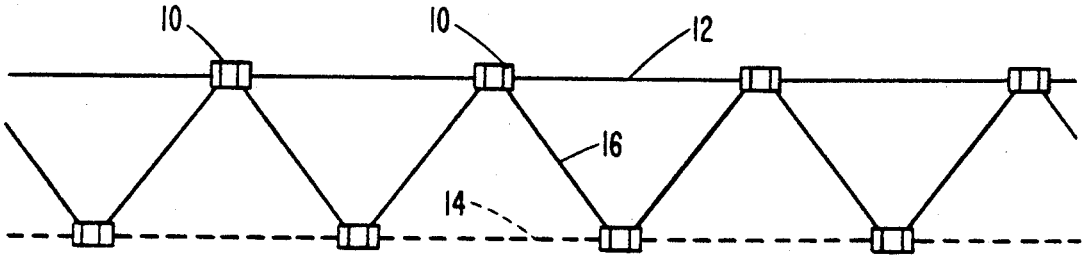
FIG. 2
FIG. 3
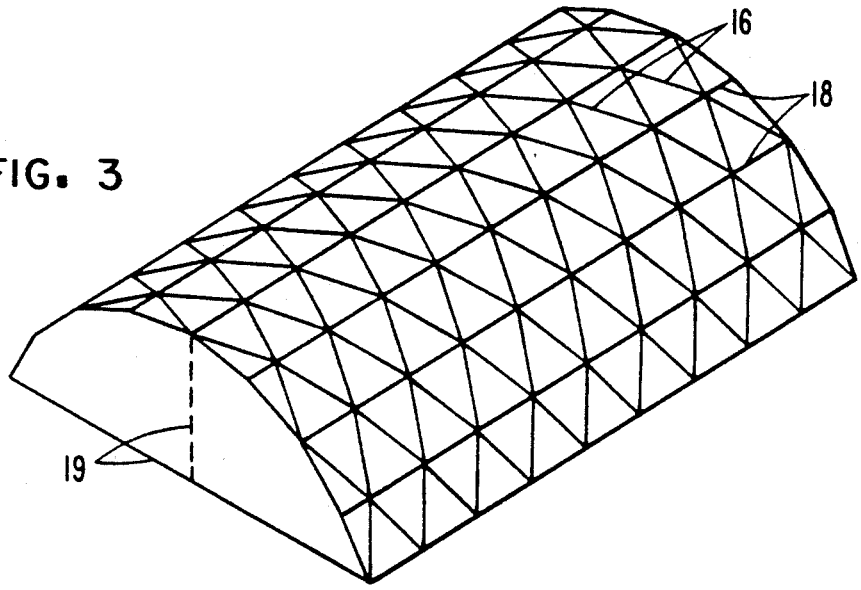

FIG. 4
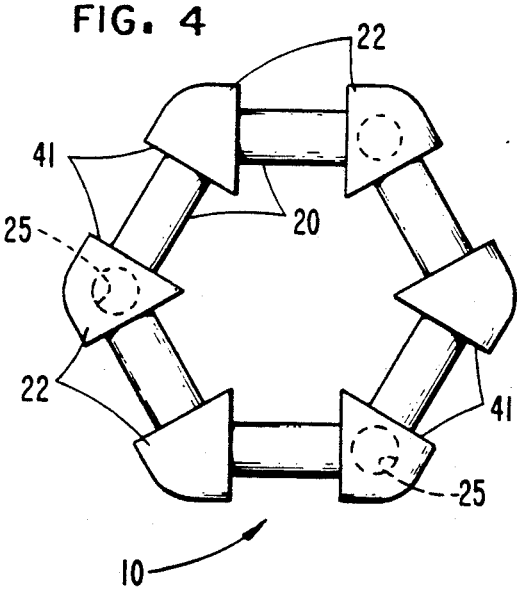
FIG. 5
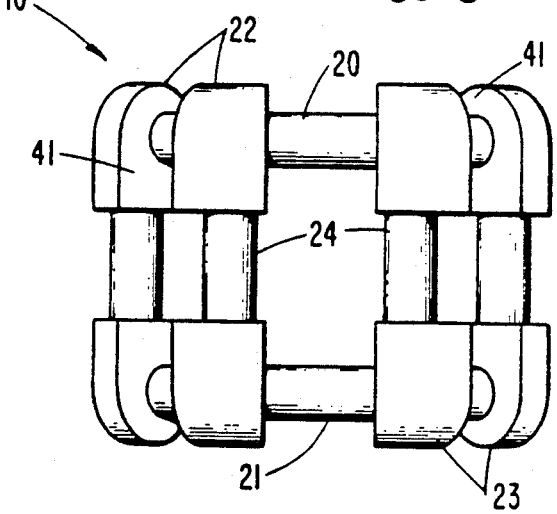
FIG. 7
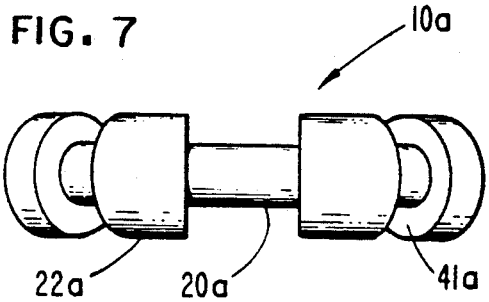
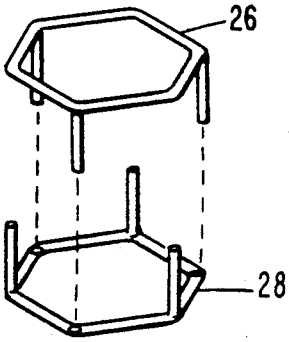
FIG. 6
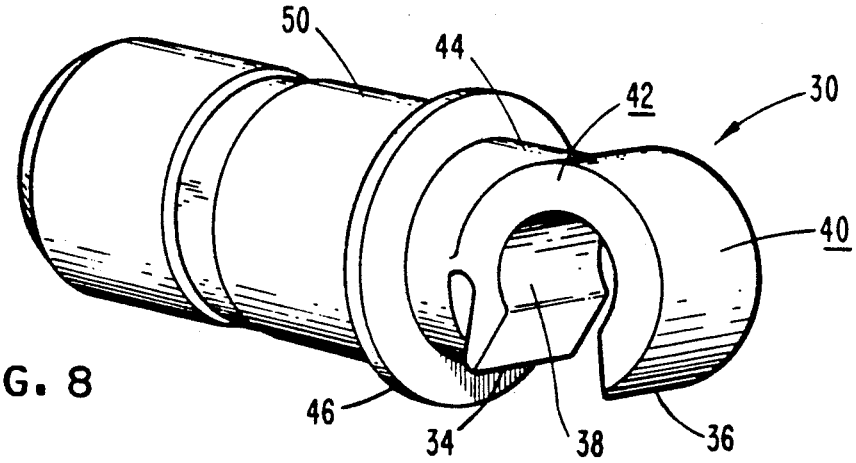
FIG. 8

MODULAR SYSTEM FOR SPACE FRAME STRUCTURES

BACKGROUND AND SUMMARY OF THE INVENTION

The present invention relates to a system for constructing space frames and, more particularly, to a modular system including hubs in combination with cylindrical tubes or struts which can be used to make simple, lightweight structures which are easily assembled.

Space grid and frame structures have long been used in architectural and engineering projects. Such structures are popular because of the repetitive nature of the design, wherein a basic geometric configuration is used. A base module is used repeatedly simply by adding more joints and connecting members to create a structure of a particular shape. The traditional space frame and grid structure comprises a grid of intersecting members forming a pattern of triangles which imparts rigidity and structural integrity to the grid. The use of rigid hubs, usually in the form of a ball with axial tapped holes in rectangular, orthoganal and hexagonal directions, is a consequence of the commitment to mathematical modeling and geometric regularity. Using the minimum number of triangular patterns minimizes the number of different angular relationships and tube lengths, so that the same type of hub may be used repeatedly throughout the structure. For example, the German "Mero" and "Meroform", and the American "Unistruct" are well known systems in which the cylindrical tubes or struts are rigidly connected at a particular angle relative to a static joint. Such systems are limited in that they provide no flexibility for adjusting the central converging angle of the struts in bridging of a static joint. As a result, the possibilities of forming geometrical patterns are limited.

An object of the present invention is to provide a universal static hub which ha maximum flexibility in joining and securing cylindrical tubes or struts to such a hub in constructing decorative frameworks.

Another object of the invention is to provide a flexible joint in a structural framework which has the ability to generate all forms of geometric configuration, both curved and planar.

Yet another object of the invention is to provide an assembly which is neat and simple, and to provide an assembly in which bolts are not required.

Still another object of the invention is to provide a static hub in which up to 18 struts may be connected.

A further object of the invention is to provide a decorative framework in which the geometric patterns may differ and which, therefore, is usable to enclose irregular spaces.

These and other objects and advantages of the invention are achieved with a modular system which includes a crystal-like static hub which may have one or more planar arrays of interconnected trunnions. In one embodiment, the trunnions are arranged to form a generally octahedral-hexagonal prism. The prism is formed by joining two hexagonal planar arrays of trunnions, each array having six nodes. The trunnions of the crystal-like hub are engaged by end grips which are attached to opposite ends of tubular members or struts. The end grips have a C-shaped section which clips into engagement with a trunnion. The C-shaped section has flat end surfaces which abut the nodes at the opposite ends of the trunnion to which the end grip is attached.

The end grip is axially fixed to the strut, but free to rotate about the axis of the strut. The crystal-like hub can be used to attached up to 18 such end grips. Since the end grips are free to rotate about the trunnion, and since the struts are free to rotate about the end grips, a wide variety of angular relationships can be used to create structures of a nearly infinite variety of configurations.

BRIEF DESCRIPTION OF THE DRAWINGS

The objects and advantages of the invention will become apparent upon a reading of the following specifications, read in conjunction with the accompanying drawings, wherein:

FIG. 1 is a plan schematic view of a structural configuration in accordance with the present invention; and FIG. 2 is a side elevational schematic view of the arrangement shown in FIG. 1; and FIG. 3 is a perspective schematic view of an alternative arched structural arrangement in accordance with the present invention; and FIG. 4 is a plan view of a crystal-like hub made in accordance with the present invention; and FIG. 5 is a side elevational view of the crystal-like hub shown in FIG. 4; and FIG. 6 is a schematic perspective view showing the manner in which the hub of FIGS. 4 and 5 is made; and FIG. 7 is a side elevational view of a first alternative embodiment of a crystal-like hub made in accordance with the present invention; and FIG. 8 is a perspective view of an end grip made in accordance with the present invention.

DETAILED DESCRIPTION OF THE INVENTION

Figure 9:
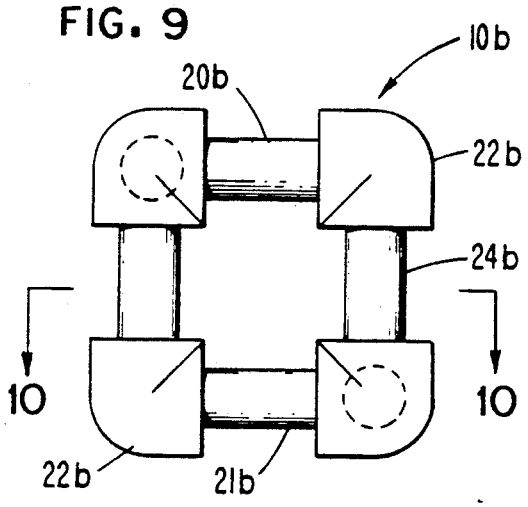
FIG. 9 is a plan view of a second alternative embodiment of a crystal-like hub of the present invention.

FIGS. 1, 2 and 3 show two embodiments of the present invention in assembled form. FIGS. 1 and 2 show an example of a framework which is generally planar. The crystal-like hubs 10 shown in FIGS. 1 and 2 are used to connect upper struts 12, lower struts 14, and diagonal struts 16. The means by which such framework as is shown in FIGS. 1 and 2 can be attached to a building are not shown. However, means by which the framework can be attached to a building include a combination of fasteners and wire, such as those which are typically used to hang suspended ceilings. Alternatively, the framework shown in FIGS. 1 and 2 could be freestanding if placed on vertical supports, which may or may not be made of the strut/hub arrangement of the present invention.

As will be discussed later, the crystal-like hubs of the present invention allow a variety of structural configurations. FIG. 3 shows an arched array of struts in which hubs (not shown in FIG. 3) are used to connect longitudinal struts 18 and diagonal struts 16. The arcuate configuration is held in place with long struts 19.

FIGS. 4 and 5 are bottom and side views, respectively, of an octahedral hexagonal hub which is comprised of twelve nodes, six upper nodes 22, and six lower nodes 23. Each of the nodes receives three trunnions. The upper trunnions 20 link the upper nodes 22, and the lower trunnions 21 link the lower nodes 23. The vertical trunnions 24 each join an upper and a lower node. FIG. 6 shows schematically the manner in which the orthogonal hexagonal hub 10 is put together. An upper half-hub 26 which includes the upper nodes 22, the upper trunnions 20 and three vertical trunnions 24, is molded as a single unit in a two plate mold. A lower half-hub 28 which is identical in shape and which can be made from the same mold as the upper half-hub 26 includes the lower nodes 23 the lower trunnions 21, and three vertical trunnions. The vertical trunnions of each of the half-hubs 26 and 28 are alternating so that when the half-hubs are aligned as shown in FIG. 6, they can be joined to form the completed crystal-like hub 10 shown in FIGS. 4 and 5. Similarly, three alternating nodes on each half-hub have bores 25 (See 20 FIG. 4) to receive the trunnions carried by mating half-hub. The preferred method of joining the upper and lower half-hubs is by sonic welding, but other techniques such as solvent welding, etc., may be used.

FIG. 7 shows a first alternative embodiment of a crystal-like hub **10*a*. The crystal-like hub 10*a* is similar to the upper portion of the crystal-like hub 10. The hub 10*a* does not have vertical trunnions. Nor does it have lower nodes or lower trunnions. The hub 10*a*** is a hexagonal generally planar ring which can connect up to six struts.

Figure 12:
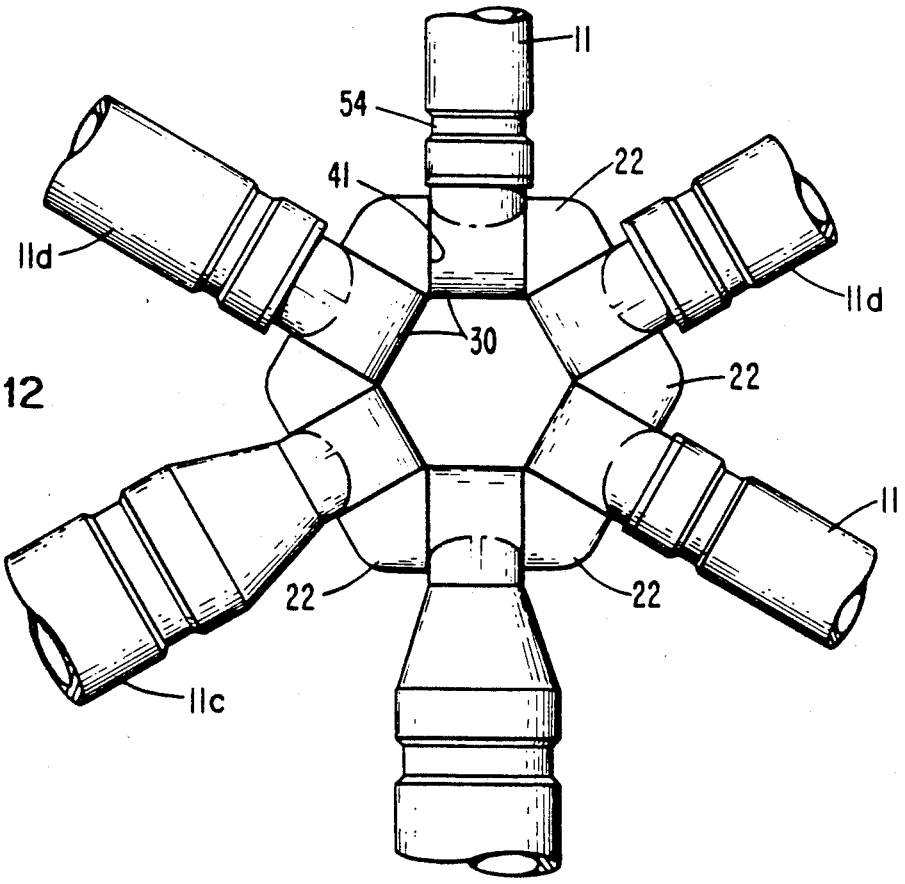
FIG. 12 is a plan view of a crystal-like hub in accordance with the present invention with end grips and struts attached thereto.

FIG. 8 shows an end grip 30 which is used to connect a strut to a hub in accordance with the present invention. The end grip 30 includes a C-shaped section 32 which projects from a stem 50. The C-shaped section is connected to the stem by a neck 44. The end grip 30 further includes a collar 46. The C-shaped section has an inner cylindrical surface 38 and an outer cylindrical surface 40 which are generally concentric and spaced from each other to form flat sides 42. The inner and outer ends 34 and 36 are resilient so that the C-shaped section can open slightly to snappingly engage the trunnions 20, 21 and 24. The inner cylindrical surface 38 is shaped to closely match the cylindrical surface of the trunnions. Similarly, the width of the C-shaped section 32 is substantially equal to the distance between the various nodes 22 and 23, so that the annular side surfaces 41 of the nodes abut and guide the flat side 42 of the end grips. Further-more, the radius of the outer cylindrical surface 40 is generally equal to the radius associated with the outer surfaces of the nodes. The relationship between the outer surfaces of the C-shaped section and the nodes provides the end grip/hub assembly with a neat appearance, as can be seen in FIG. 12.

Figure 10:
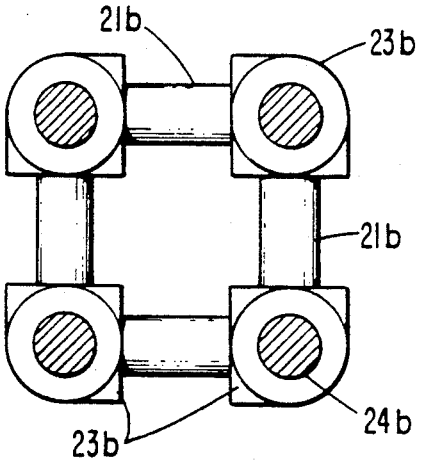
FIG. 10 is a sectional view taken along line 10—10 of FIG. 9.
Figure 11:
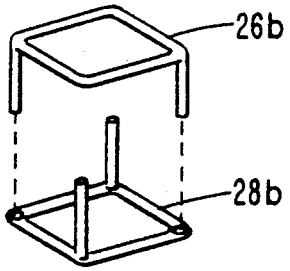
FIG. 11 is a schematic perspective view of the manner in which the crystal-like hub of FIGS. 9 and 10 is made.

FIGS. 9, 10 and 11 show a second alternative of a crystal-like hub **10*b* of the present invention. The hub 10*b* is generally cubical in configuration and includes a set of four upper nodes 22*b*, four upper trunnions 20*b*, four vertical trunnions 24*b*, four lower nodes 23*b*, and four lower trunnions 21*b*. Thus, the hub 10*b* provides a total of 12 attachment locations for end grips of the present invention. It should be noted that the spacing between the nodes of the various hubs 10, 10*a* and 10*b*** is made to be the same, so that a combination of hubs will be usable in a given structure so that a user of the system can design a structure with complete flexibility.

Similar to the manner in which the octahedral hexagonal hub 10 is assembled (as shown in FIG. 6), FIG. 11 shows the manner in which the cubical hub **10*b* is assembled. The upper and lower half-hubs 26*b* and 28*b* are identical, and each has two vertical trunnions 24*b*. The two half-hubs are brought together in the manner shown in FIG. 11 and are sonically welded or otherwise connected to form the cubical hub shown in FIGS. 9 and 10**.

Figure 13:
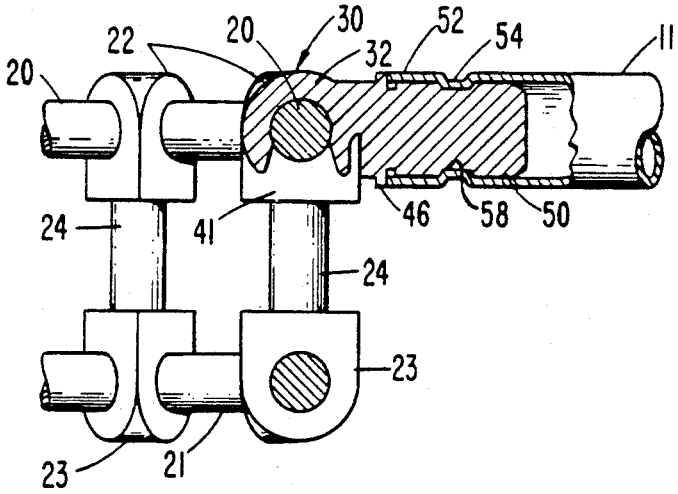
FIGS. 13 and 14 are sectional views which show the engagement of an end grip and a crystal-like hub in accordance with the present invention.
Figure 14:
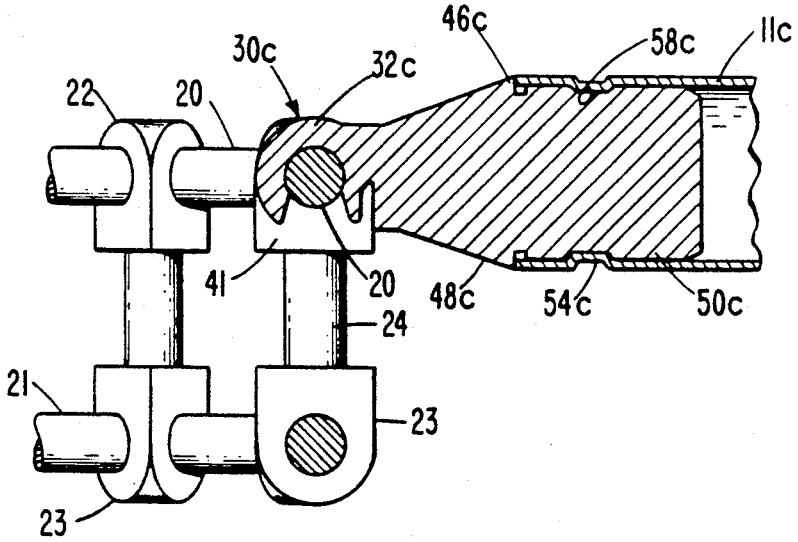
Figure 15:
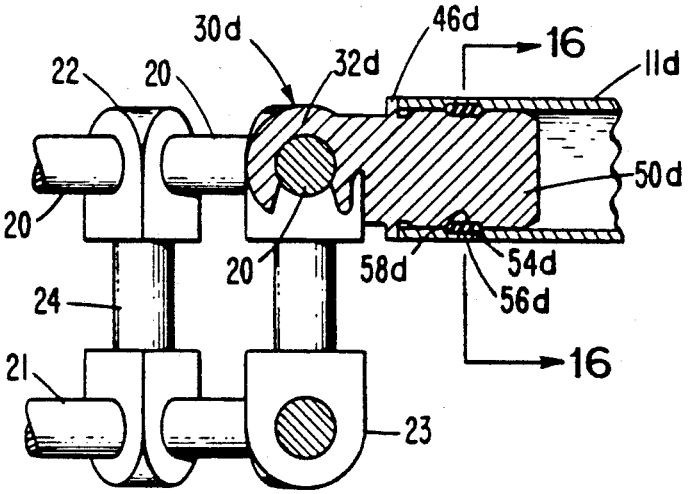
FIG. 15 is a sectional view which shows an alternative embodiment of the engagement between a strut and an end grip in accordance with the present invention.

FIGS. 13, 14 and 15 are sectional views which show the manner in which a tubular strut 52 is connected to an end grip 30, and these figures show the manner in which the end grip is attached to a hub 10. FIG. 13 shows an end grip 30 with its stem 50 inserted into the end 52 of the tubular strut 11. The wall of the tubular strut 11 has been deformed inwardly to form an annular ring 54 which engages a complementary annular recess 58 formed in the end grip 30. The collar 46 is adjacent to the end 52 of the tubular strut 11. The engagement between the annular ring 54 and the annular recess 58 allows rotation of the strut 11 relative to the end grip 30. Thus, the grip 30 is free to rotate within the end of the strut 11 about the longitudinal axis of the strut 11. However, axial movement between the strut 11 and the end grip 30 is limited both by the engagement of the ring 54 and the recess 58 and by the abutment of the end 52 and the collar 46. FIG. 14 shows a larger sized end grip **30*c* in which the stem 50*c* is connected to the C-shaped section 32*c* by a tapered collar section 48. The end grip 30*c* and the larger diameter strut 11*c* are connected to one another in the same manner as is described with reference to the embodiment shown in FIG. 13**.

Figure 16:
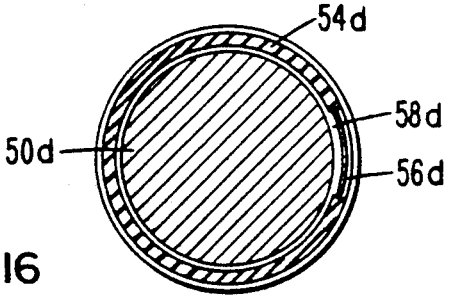
FIG. 16 is a sectional view taken along line 16—16 of FIG. 15.

FIG. 15 shows an alternative method of attaching a strut **11*d* to an end grip 30*d*. The tubular strut 11*d* has been modified to include an annular interior recess 56. A resilient retaining ring 54*d* is disposed between the annular recess 58*d*, which is formed in the stem 50*d*. As can be seen in FIG. 16, the depth of the annular recess 58 is sufficient to allow resilient deformation of the ring 54*d* so that the stem may be inserted into the end 52*d* of the strut 11*d*. When the annular ring is in alignment with the internal annular recess 56*d*, the ring 54*d* will expand into engagement with the recess 56*d* and will prevent relative axial movement of the stem 50*d* and the strut 11*d* while allowing relative rotation between the stem 50*d* and the strut 11*d***.

As can be seen in FIG. 12, tubular struts of various diameters are attached to a crystal-like hub. The C-shaped sections of each end grip are identical. The need for tubular struts of larger or smaller diameter will depend upon the structural function of the strut. For longer spans, larger diameters will provide larger moments of inertia and greater resistance to bending. In contrast, when a strut is entirely in tension, a smaller diameter tubular strut may suffice. However, when a strut is in compression, a larger diameter may be required to resist buckling. The universal nature of the crystal-like hub and end grip configurations enable a designer to accommodate all of the structural requirements which may arise in designing an irregular framework.

The materials used in the various components include plastic and metal. The crystal-like hub 10 is preferably made of an injection molded ABS plastic. Similarly, the end grips 30 are also preferably made of ABS plastic. Alternatively, PVC plastic may be used. However, the tubular struts 11 are preferably made of aluminum. The combination of plastic and aluminum makes the resulting framework as light weight as possible. The nature of the components makes them easy to assemble, transport and support. The resilient retaining ring 54*d* can be made of either plastic or metal, but is preferably steel.

While the invention has been described with respect to particular embodiments shown and discussed above, numerous alternatives, modifications and variations will occur to those who read and understand this specification. It is intended that all such alternatives, modifications and variations be included within the spirit and scope of the following claims:

I claim:

1. A coupling system for lightweight structures comprising a crystal-like hub having a plurality of trunnions joined at enlarged joints, said trunnions being generally cylindrical members, said crystal-like hub having at least two pairs of parallel trunnions, said system including at least one strut with end grips, said end grips being attached to opposite ends of said strut, each of said end grips comprising generally C-shaped resilient gripping means for snappingly engaging said strut with and disengaging said strut from one of said trunnions with a simple pushing motion, said crystal-like hub defining a plurality of planes, comprised of two identical mating half-hubs, each half-hub having an odd number of cantilevered trunnions extending therefrom prior to being joined with a mating half-hub.

2. A coupling system for lightweight structures in accordance with claim 1 wherein:

said crystal-like hub has three pairs of parallel trunnions.

3. A coupling system for lightweight structures in accordance with claim 1 wherein:

said crystal-like hub defines a generally eight sided configuration, two of said sides being parallel hexagonal side being spaced from each other by six trunnions, and each hexagonal side being comprised of six trunnions.

4. A coupling system for lightweight structures in accordance with claim 1 further including a strut with end grips, said end grips being attached to opposite ends of said strut.

5. A coupling system for lightweight structures in accordance with claim 1 wherein:

said joints have at least two flat annular surfaces, said trunnions having one flat annular surface at each end thereof, the flat annular surfaces at each end of a trunnion being parallel with each other.

6. A coupling system for lightweight structures in accordance with claim 6 wherein:

said strut has a longitudinal axis, said end grips being axially fixed to said opposite ends, but free to rotate about the longitudinal axis of the strut.

7. A coupling system for lightweight structures in accordance with claim 6 wherein:

said gripping means comprises a clip having two ends which are resiliently flexible and which are spaced from each other, each of said end grips further including a stem with surface means to facilitate the attachment of said stem to the inside of a tubular strut, and a flange between said clip and said stem to limit the penetration of said stem into a tubular strut.

8. A coupling system for lightweight structures in accordance with claim 7 wherein:

said clip has a width generally equal to the distance between said joints whereby lateral movement of said strut relative to said trunnion is prevented.

9. A coupling system for lightweight structures in accordance with claim 8 wherein:

said clip has a pair of flat C-shaped surfaces which match and partially abut said flat annular surfaces at said ends of said trunnions.

10. A coupling system for lightweight structures in accordance with claim 7 wherein:

said strut is a tubular metal element deformed into engagement with said stem.

11. A coupling system for lightweight structures in accordance with claim 6 wherein:

each of said end grips is attached to one of said opposite ends by means of a ring carried by said strut which engages an annular depression formed in said end grip.

12. A coupling system for lightweight structures in accordance with claim 11 wherein:

said ring is formed in said opposite end by inward deformation of a portion thereof, such that said ring is an integral part of said strut.

13. A coupling system for lightweight structures in accordance with claim 11 wherein:

said ring is a separate C-shaped component held in an annular groove formed on an interior surface of said opposite end of said strut, said ring being resilient so as to enable it to be snapped into position in said groove, said ring being initially placed in said annular depression on said end grip prior to placement of said ring in said groove.

14. A coupling system for lightweight structures in accordance with claim 13 wherein:

said annular depression and said ring having substantially similar cross-sectional configurations.

* * * * *